US008801143B2

(12) United States Patent
Yamashiro

(10) Patent No.: US 8,801,143 B2
(45) Date of Patent: Aug. 12, 2014

(54) IMAGE FORMING APPARATUS, RECORDING HEAD MAINTENANCE OPERATION CONTROL METHOD, AND COMPUTER-READABLE RECORDING MEDIUM HAVING A RECORDING HEAD MAINTENANCE OPERATION CONTROL PROGRAM

(75) Inventor: Toshihiro Yamashiro, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1207 days.

(21) Appl. No.: 12/646,002

(22) Filed: Dec. 23, 2009

(65) Prior Publication Data

US 2010/0225683 A1 Sep. 9, 2010

(30) Foreign Application Priority Data

Mar. 5, 2009 (JP) ..... 2009-052468

(51) Int. Cl.
*B41J 2/165* (2006.01)

(52) U.S. Cl.
CPC ..... *B41J 2/165* (2013.01); *B41J 2002/16573* (2013.01)
USPC ..... 347/22; 347/19

(58) Field of Classification Search
CPC ..... B41J 2/165–2/16585; B41J 2002/16573
See application file for complete search history.

(56) References Cited

U.S. PATENT DOCUMENTS

2003/0063142 A1* 4/2003 Sakamoto et al. ..... 347/5
2009/0028586 A1 1/2009 Yamashiro et al.
2009/0237744 A1 9/2009 Ogura et al.

FOREIGN PATENT DOCUMENTS

JP 2007-136772 6/2007

* cited by examiner

*Primary Examiner* — Jerry Rahill
(74) *Attorney, Agent, or Firm* — Oblon, Spivak, McClelland, Maier & Neustadt, L.L.P.

(57) ABSTRACT

An image forming apparatus includes a recording head for discharging an ink droplet onto a recording medium in a print operation; a maintenance operation unit performing a primary maintenance operation on the recording head after a predetermined time following completion of the print operation; a standing time calculation unit calculating a standing time between a completion time of a secondary maintenance operation performed in the predetermined time and an end time of the predetermined time; an intensity comparing unit comparing an intensity of the primary maintenance operation and an intensity of the secondary maintenance operation; and a selection unit selecting a type of the primary maintenance operation based on the standing time when the intensity of the secondary maintenance operation is greater than the intensity of the primary maintenance operation.

9 Claims, 13 Drawing Sheets

FIG.6

TYPE TABLE 330

| ID | STANDING TIME | MAINTENANCE OPERATION | |
|---|---|---|---|
| | | AIR NOT DETECTED | AIR DETECTED |
| 1 | LESS THAN 10 H | DO NOTHING | DO NOTHING |
| 2 | 10 H TO LESS THAN 24 H | BLANK DISCHARGE (LOW) | OPEN-TO-ATMOSPHERE /LOADING OPERATION |
| 3 | 24 H TO LESS THAN 7 DAYS | BLANK DISCHARGE (HIGH) | OPEN-TO-ATMOSPHERE /LOADING OPERATION |
| 4 | 7 DAYS TO LESS THAN 1 MONTH | CLEANING | OPEN-TO-ATMOSPHERE /LOADING OPERATION |
| 5 | 1 MONTH OR MORE | FLUID DELIVERY SEQUENCE | FLUID DELIVERY SEQUENCE |

FIG.7

INTENSITY TABLE 340

| ID | MAINTENANCE OPERATION | INTENSITY |
|---|---|---|
| 1 | DO NOTHING | LOW ↔ HIGH |
| 2 | BLANK DISCHARGE (LOW) | |
| 3 | BLANK DISCHARGE (HIGH) | |
| 4 | CLEANING | |
| 5 | OPEN-TO-ATMOSPHERE /LOADING OPERATION | |
| 6 | REFRESH | |
| 7 | FLUID DELIVERY SEQUENCE | |

IMAGE FORMING APPARATUS, RECORDING HEAD MAINTENANCE OPERATION CONTROL METHOD, AND COMPUTER-READABLE RECORDING MEDIUM HAVING A RECORDING HEAD MAINTENANCE OPERATION CONTROL PROGRAM

BACKGROUND OF THE INVENTION

1. Field of the Invention

The present invention relates to an image forming apparatus having a recording head. The invention also relates to a method of performing a recording head maintenance operation, and a computer-readable recording medium having a program for implementing the method.

2. Description of the Related Art

An inkjet image forming apparatus typically has a recording head that discharges ink droplets via a nozzle onto a recording sheet, thus forming an image on the recording sheet. In such an inkjet image forming apparatus, if the recording head is left standing for a long time after completion of the print operation, the ink around the nozzle may become viscous, or air bubbles may enter the recording head, thereby preventing a normal ink discharge operation. Thus, in conventional image forming apparatuses, it is necessary to perform an appropriate maintenance operation (recovery operation) in order to maintain or recover a normal ink discharging capability of the recording head (see Japanese Laid-Open Patent Application No 2007-136772, for example).

The appropriate maintenance operation may be selected out of a plurality of maintenance operations including blank discharge and head cleaning, depending on the duration of time that the head has been left standing after completion of the print operation. The selected maintenance operation may then be automatically performed at a predetermined timing, which may be set for a fixed time or date, or immediately before a next print operation.

FIG. 1 is a flowchart of a process of determining a maintenance operation for a conventional image forming apparatus. When it is time for a maintenance operation, the image forming apparatus acquires information about the time at which the recording head started being left standing (hereafter referred to as a "standing start time") (step S11). Then, the image forming apparatus acquires the time at which the recording head ceased being left standing (hereafter referred to as a "standing end time") (step S12). The image forming apparatus then calculates the duration of time in which the recording head has been left standing (hereafter referred to as a "standing time") (step S13). The "standing start time" corresponds to the time at which the last print operation was completed. The standing start time may be stored in a non-volatile memory of the image forming apparatus upon completion of the print operation. The "standing end time" substantially corresponds to the time at which the maintenance operation starts, which may be referred to as a "maintenance operation start time". The image forming apparatus then selects a maintenance operation that is actually performed (step S14), depending on the duration of the standing time calculated in step S13, and then performs the maintenance operation (step S15).

Normally, maintenance operations with greater intensity are selected with increasing standing time. Generally, as the intensity of the maintenance operation increases, more ink is consumed and the operation takes longer. Thus, various methods have been proposed to reduce ink consumption in the maintenance operation, as discussed in Patent Document 1.

In accordance with the above-discussed process, the maintenance operation is selected depending on the standing time that has elapsed since the last print operation was completed. For this reason, if a separate maintenance operation is carried out after completion of the print operation and before the implementation of the automatic maintenance operation, the intensity of the automatic maintenance operation may prove too strong for the level of degradation of the nozzle. In this case, more ink may be spent than is actually required. Furthermore, if the maintenance operation is carried out immediately before the start of a printing operation, an additional wait time may be caused.

SUMMARY OF THE INVENTION

The disadvantages of the prior art may be overcome by the present invention which, in one aspect, is an image forming apparatus including a recording head for discharging an ink droplet onto a recording medium in a print operation; a maintenance operation unit configured to perform a primary maintenance operation on the recording head after a predetermined time following completion of the print operation; a standing time calculation unit configured to calculate a standing time between a completion time of a secondary maintenance operation performed in the predetermined time and an end time of the predetermined time; an intensity comparing unit configured to compare an intensity of the primary maintenance operation and an intensity of the secondary maintenance operation; and a selection unit configured to select a type of the primary maintenance operation based on the standing time when the intensity of the secondary maintenance operation is greater than the intensity of the primary maintenance operation.

In another aspect of the present invention, there is provided a method of controlling a recording head maintenance operation in the aforementioned image forming apparatus. The method includes calculating a standing time between a completion time of a secondary maintenance operation performed in the predetermined time and an end time of the predetermined time; comparing an intensity of the primary maintenance operation and an intensity of the secondary maintenance operation; and selecting a type of the primary maintenance operation based on the standing time when the intensity of the secondary maintenance operation is greater than the intensity of the primary maintenance operation.

In yet another aspect of the present invention, there is provided a computer-readable recording medium storing a program for implementing the aforementioned method of controlling a recording head maintenance operation. The program, when executed by one or more processors of the image forming apparatus, carries out calculating a standing time between a completion time of a secondary maintenance operation performed in the predetermined time and an end time of the predetermined time; comparing an intensity of the primary maintenance operation and an intensity of the secondary maintenance operation; and selecting a type of the primary maintenance operation based on the standing time when the intensity of the secondary maintenance operation is greater than the intensity of the primary maintenance operation.

BRIEF DESCRIPTION OF THE DRAWINGS

Other objects, features and advantages of the present invention will become apparent upon consideration of the specification and the appendant drawings, in which:

FIG. 6 is an example of a type table according to the first embodiment;

FIG. 7 is an example of an intensity table according to the first embodiment;

DETAILED DESCRIPTION OF THE PREFERRED EMBODIMENTS

In accordance with an embodiment of the present invention, a predetermined maintenance operation, which may be referred to as a "primary maintenance operation", is performed a predetermined time after completion of a print operation. In the predetermined time, a second maintenance operation, which may be referred to as a "secondary maintenance operation", may be performed. The "primary maintenance operation" is selected based on: a time difference between the time of completion of the "secondary maintenance operation" and an end time of the predetermined time; an intensity of the secondary maintenance operation; and an intensity of the primary maintenance operation.

First Embodiment

Structure of Information Processing Apparatus

Figure 1:
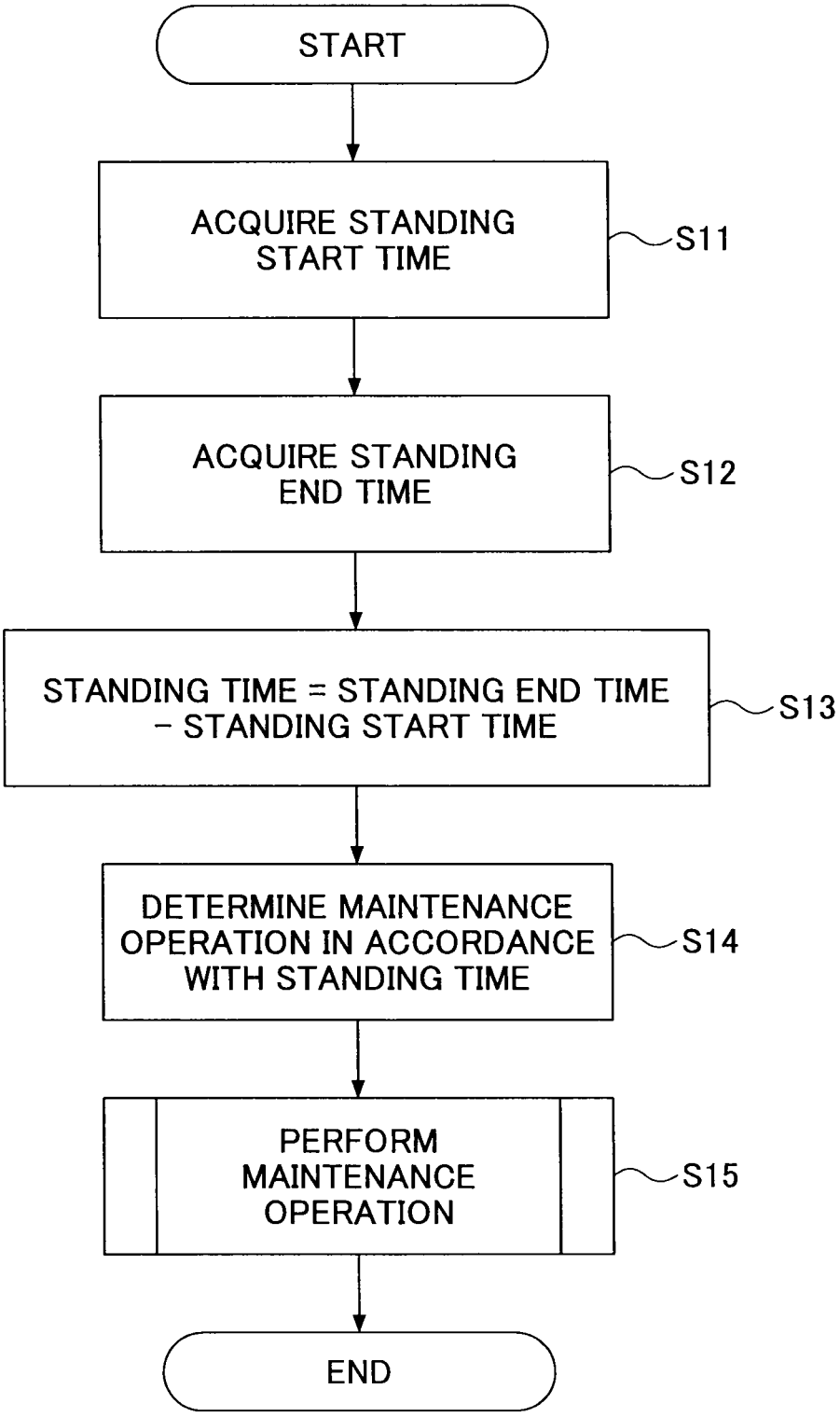
FIG. 1 is a flowchart of a conventional maintenance operation.
Figure 2:
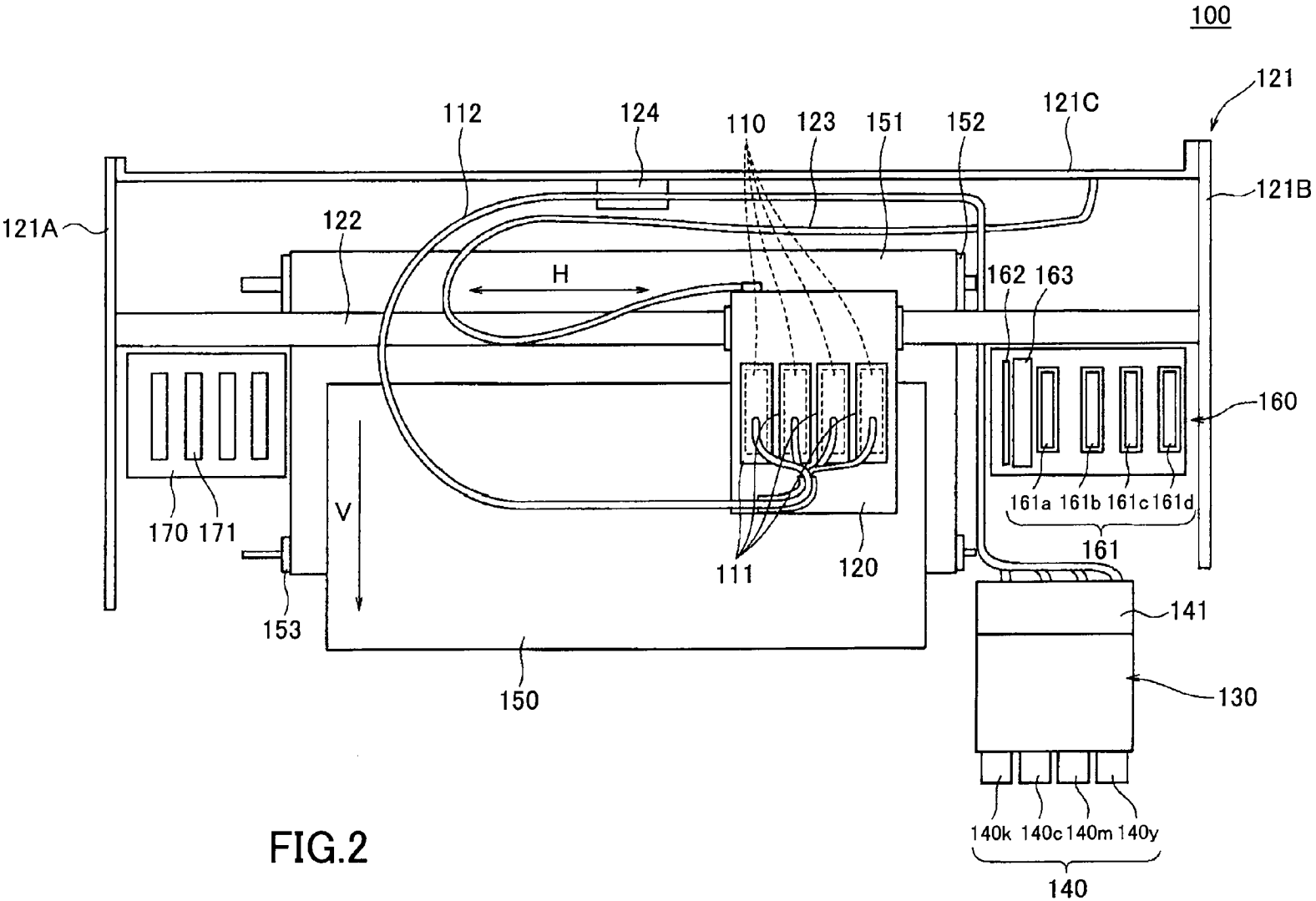
FIG. 2 depicts an image forming apparatus according to a first embodiment of the present invention.

FIG. 2 depicts an image forming apparatus 100 according to the first embodiment of the present invention. The image forming apparatus 100 includes a carriage 120 on which plural, such as four, inkjet recording heads 110 are mounted. The carriage 120 is slidably supported by a guide rod 122 such that the carriage 120 can be moved in a horizontal-scan direction H. The guide rod 122 is horizontally extended between side plates 121A and 121B of a frame 121. The carriage 120 may be configured to be moved by a horizontal-scan motor (not shown) via a timing belt (not shown) in the horizontal-scan direction H.

The four recording heads 110 may be configured to discharge ink droplets of yellow (Y), cyan (C), magenta (M), and black (Bk). The four recording heads 110 may have ink discharge openings (not shown) arranged in a direction perpendicular to the horizontal-scan direction such that the ink droplets can be discharged downward.

The recording heads 110 may include a pressure generating unit (not shown) for generating a pressure for discharging ink droplets. The pressure generating unit may include a piezoelectric actuator; a thermal actuator utilizing a phase change by the film boiling of a liquid which may be caused by an electro-thermal conversion element such as a heat-generating resistor; a shape-memory alloy actuator utilizing a metal phase change due to temperature changes; or an electrostatic actuator utilizing electrostatic force. The recording heads 110 may also include a driver IC (not shown) connected with a control unit (not shown) via harnessing, such as a flexible printed cable 123.

The carriage 120 also carries sub-tanks 111 for supplying the individual colors of ink to the recording heads 110. The sub-tanks 111 are supplied with the individual colors of ink from ink cartridges 140*k*, 140*c*, 140*m*, and 140*y* (which may be collectively referred to as an "ink cartridge 140") attached to the cartridge loading unit 130, via ink supply tubes 112. The cartridge loading unit 130 includes a supply pump unit 141 for supplying the ink from the ink cartridge 140. The ink supply tubes 112 are retained in place by a retainer 124 onto a back plate 121C of the frame 121.

The image forming apparatus 100 includes a transport belt 151 for transporting a sheet 150 from a sheet feeding unit (not shown) to a position under and opposite to the recording heads 110. The transport belt 151 may include an endless belt extended across a transport roller 152 and a tensioning roller 153. The transport roller 152 may be rotated by a vertical-scan motor (not shown) at a predetermined timing so that the transport belt 151 can be rotated in a belt transport direction (vertical-scan direction V).

The image forming apparatus 100 further includes a maintain/restore mechanism 160 for maintaining or restoring a normal state of the nozzles of the recording heads 110. The maintain/restore mechanism 160 may be disposed in a non-print area on one side of the carriage 120 along the horizontal-scan direction H. The maintain/restore mechanism 160 includes caps 161*a*, 161*b*, 161*c*, and 161*d* (which may be collectively referred to as a "cap 161"), a wiper blade 162, and a blank discharge pan 163.

The cap 161 is configured to cap a nozzle surface of each of the recording heads 110. In accordance with the present embodiment, the cap 161*a* is used as a suction/moistening cap while the other caps 161*b*, 161*c*, and 161*d* are used as moistening caps. The wiper blade 162 is a blade member for wiping the nozzle surface. The blank discharge pan 163 is configured to receive ink droplets during a blank discharge operation in which ink droplets that do not contribute to printing ("non-recording ink droplets") are discharged for the purpose of ejecting a recording fluid with increased viscosity.

A waste recording fluid produced in a maintain/restore operation by the maintain/restore mechanism 160, the ink discharged into the cap 161, the ink that had attached to the wiper blade 162 and was then removed by the wiper cleaner, or the ink blank-discharged into the blank discharge pan 163 may be ejected into a waste fluid tank (not shown).

The image forming apparatus 100 also includes another blank discharge pan 170 in a non-print area on the other side along the scan direction of the carriage 120. The blank discharge pan 170 is configured to receive droplets during a blank discharge in which non-recording ink droplets are discharged in order to eject the recording fluid that has become viscous during a recording operation, for example. The blank discharge pan 170 includes openings 171 arranged parallel to the lines of the nozzles of the recording heads 110.

In the image forming apparatus 100, the sheet 150 fed onto the transport belt 151 is transported in the vertical-scan direction V by the rotating movement of the transport belt 151 while the sheet 150 is adsorbed onto the transport belt 151.

When the sheet 150 is stopped, the recording heads 110 are driven in accordance with an image signal while the carriage 120 is moved in the horizontal-scan direction H. As a result, ink drops are discharged onto the sheet 150, thereby printing (recording) a line of print data. The sheet 150 is then transported in the vertical-scan direction V by a predetermined distance, followed by the printing of the next line. The print operation may be ended in response to a print end signal or a signal indicating that the trailing edge of the sheet 150 has reached the recording area. The sheet 150 may be then ejected into a copy receiving tray (not shown).

During a print standby period, the carriage 120 is moved to the maintain/restore mechanism 160 where the recording heads 110 are capped with the cap 161 so as to keep the nozzles moistened and prevent a discharge defect due to dried ink. With the recording heads 110 capped with the cap 161, a recovery operation may be performed in which the recording fluid is sucked out of the nozzles using a suction pump (not shown) in order to eject air bubbles or the recording fluid that has become viscous. Prior to, or during a print operation, a blank discharge operation may be performed to discharge the non-recording ink droplets. In this way, a stable discharge performance of the recording heads 110 can be maintained.

Figure 3:
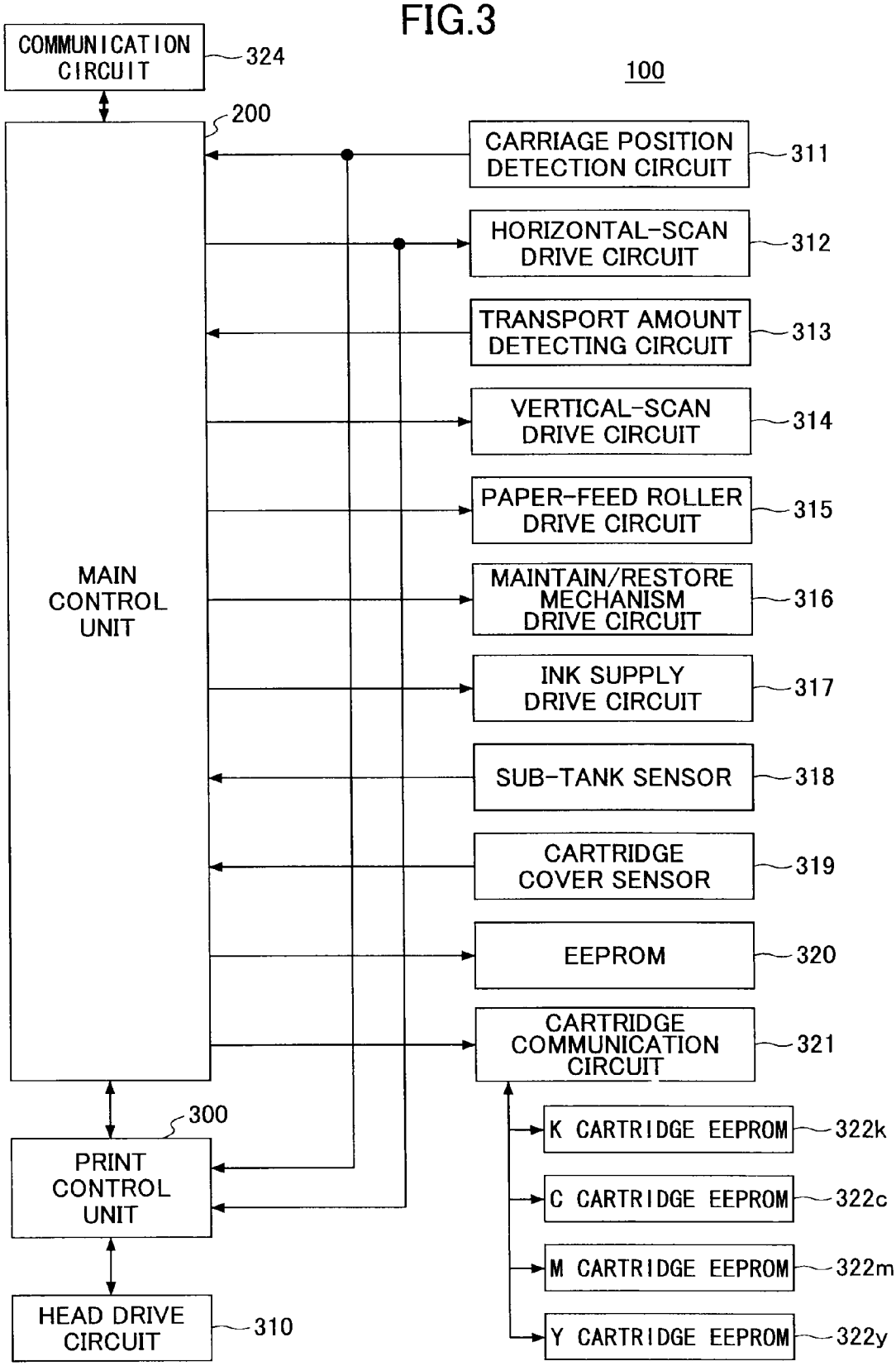
FIG. 3 is a block diagram of a functional structure of the image forming apparatus according to the first embodiment.

With reference to FIG. 3, a functional structure of the image forming apparatus 100 according to the present embodiment is described. The image forming apparatus 100 includes a main control unit 200, a print control unit 300, a head drive unit 310, a carriage position detecting circuit 311, a horizontal-scan drive circuit 312, a transport amount detecting circuit 313, a vertical-scan drive circuit 314, a roller drive circuit 315, a maintain/restore mechanism drive circuit 316, an ink supply drive circuit 317, a sub-tank sensor 318, a cartridge cover sensor 319, a non-volatile memory (EEPROM) 320, a cartridge communication circuit 321, and a communication circuit 324.

The main control unit 200 controls the image forming apparatus 100 as a whole. The main control unit 200 may include a microprocessor. For example, the main control unit 200 controls the driving of the horizontal-scan motor or the vertical-scan motor (which are not shown) via the horizontal-scan drive circuit 312 or the vertical-scan drive circuit 314 based on print process information fed via the communication circuit 324, in order to form an image on the sheet 150. The main control unit 200 may also control the output of print data to the print control unit 300.

The carriage position detecting circuit 311 may be configured to detect the position of the carriage 120 by counting the number of slits in an encoder sheet disposed in the horizontal-scan direction H of the carriage 120 using a photosensor mounted on the carriage 120. The main control unit 200 may be configured to control the position or transport speed of the carriage 120 based on a detection signal sent from the carriage position detecting circuit 311. The horizontal-scan drive circuit 312 may be configured to drive the horizontal-scan motor in accordance with a carriage transport amount fed from the main control unit 200 so that the carriage 120 can be moved to a predetermined position at a predetermined speed. The transport amount detecting circuit 313 detects a transport amount of the transport belt 151. The transport amount detecting circuit 313 may be configured to detect the transport amount by counting the number of slits in a rotary encoder sheet attached to a rotation axle of the transport roller 152, using a photosensor. The main control unit 200 may be configured to control the transport amount and transport speed of the transport belt 151 based on a detection signal sent from the transport amount detecting circuit 313.

The vertical-scan drive circuit 314 may be configured to drive the vertical-scan motor in accordance with a transport amount fed from the main control unit 200 in order to drive the transport roller 152 so that the transport belt 151 can be moved to a predetermined position at a predetermined speed. The roller drive circuit 315 may be configured to rotate a feeding roller (not shown) in accordance with a feeding roller drive instruction fed from the main control unit 200.

The main control unit 200 may control the driving of a maintain/restore mechanism motor (not shown) via the maintain/restore mechanism drive circuit 316 in order to lift or lower the cap 161 or the wiper blade 162. The main control unit 200 may also control the driving of an ink supply motor for driving a pump in the supply pump unit 141 via the ink supply drive circuit 317. The main control unit 200 may also control the supply of ink from the ink cartridge 140 in the cartridge loading unit 130 to the sub-tanks 111.

The main control unit 200 may be supplied with a detection signal from the sub-tank sensor 318 indicating that the sub-tank 111 is full, or a detection signal from the cartridge cover sensor 319 detecting the opening or closing of a front cover of the cartridge loading unit 130. The main control unit 200 may also acquire information stored in non-volatile memories 322*k*, 322*c*, 322*m*, and 322*y*, via the cartridge communication circuit 321 in order to perform a required process. The non-volatile memories 322*k*, 322*c*, 322*m*, and 322*y* are storage units provided for the ink cartridges 140*k*, 140*c*, 140*m*, and 140*y*, respectively. Information about the result of a process may be stored in the EEPROM 320 as a main storage unit.

The print control unit 300 may be configured to generate print data based on a signal from the main control unit 200 and information about the carriage position or transport amount supplied from the carriage position detecting circuit 311 or the transport amount detecting circuit 313. The generated print data is then fed to the head drive circuit 310. Based on the print data, the head drive circuit 310 drives the pressure generating unit of the recording heads 110 in order to discharge ink droplets out of their nozzles.

Recording Head Maintenance Operation

In the image forming apparatus 100, a recording head maintenance operation may be performed by the maintain/restore mechanism 160 under the control of the main control unit 200. The maintenance operation may include a maintain/restore operation for enabling a normal discharge of droplets out of the recording heads 110. Plural types of maintenance operation may be performed in the image forming apparatus 100, as will be described later.

After completion of a print operation, if the recording heads 110 are allowed to stand for a predetermined time, a first maintenance operation, which may be referred to as a "primary maintenance operation", corresponding to the predetermined time is performed. The predetermined time may be the time between the end of the print operation and the start of the next print operation. Alternatively, the predetermined time may be the time between the end of the print operation and a preset time.

In accordance with the present embodiment, if a second maintenance operation, which may be referred to as a "secondary maintenance operation", is performed before the predetermined time elapses following the completion of the print operation, the primary maintenance operation is adjusted based on the intensity of the secondary maintenance operation, and the time difference between the time of completion of the secondary maintenance operation and an end time of the predetermined time.

Standing Time

Figure 4:
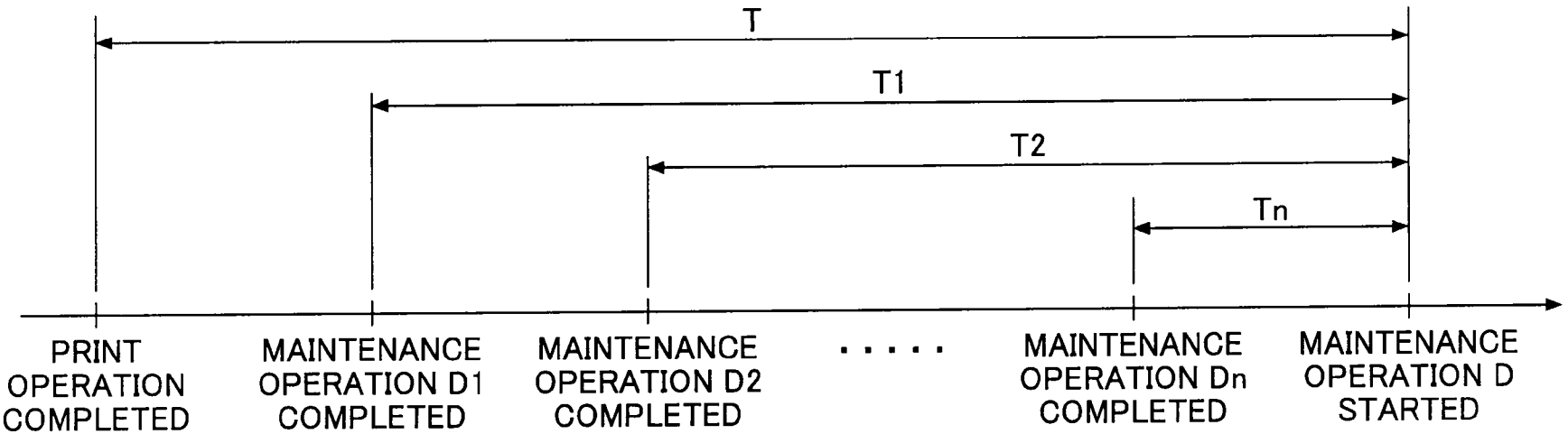
FIG. 4 illustrates the concept of a standing time in the first embodiment.

With reference to FIG. 4, the concept of the standing time in accordance with the present embodiment is described. A predetermined time between completion of a print operation and the start of the primary maintenance operation D is referred to as a "primary standing time T". Based on the primary standing time T, the primary maintenance operation D is selected by a control process which will be described later. During the primary standing time T, a plurality of the secondary maintenance operations D1, D2, . . . , Dn may be performed. The time between the end of each such secondary maintenance operation and the end time of the primary standing time T is referred to as a secondary standing time T1, T2, . . . , Tn.

Figure 5:
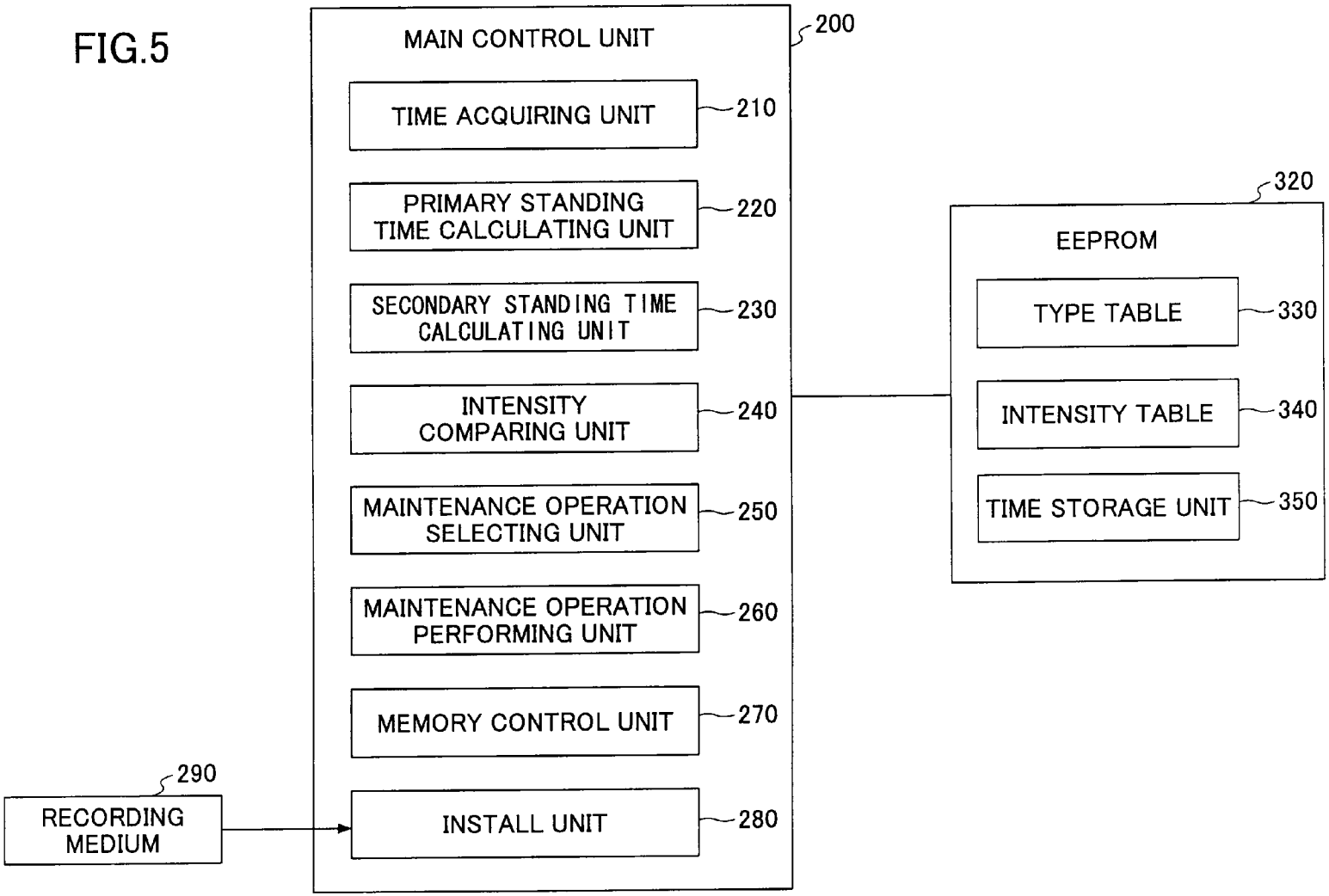
FIG. 5 is a block diagram of a functional structure of a main control unit according to the first embodiment of the present invention.

With reference to FIG. 5, a functional structure of the main control unit 200 is described. The functions of the various portions of the main control unit 200 may be realized when a recording head maintenance operation control program stored in an auxiliary storage unit or the like of the image forming apparatus 100 is read and executed by the main control unit 200.

The main control unit 200 includes a time acquiring unit 210, a primary standing time calculation unit 220, a secondary standing time calculation unit 230, an intensity comparison unit 240, a maintenance operation selection unit 250, a maintenance operation executing unit 260, a memory control unit 270, and an install unit 280.

The time acquiring unit 210 acquires various items of time information, such as the completion time of a print operation, which may be referred to as a "print operation completion time", and the start time and the completion time of a maintenance operation. Such information may be used for processes which will be described later. The primary standing time calculation unit 220 calculates the primary standing time T. The primary standing time calculation unit 220 may calculate the primary standing time T based on the print operation completion time and the end time of the primary standing time acquired by the time acquiring unit 210.

The secondary standing time calculation unit 230 calculates the secondary standing time Tn. The secondary standing time calculation unit 230 may calculate the secondary standing time Tn by acquiring the completion time of the secondary maintenance operation Dn and the end time of the predetermined standing time via the time acquiring unit 210. The intensity comparison unit 240 compares the intensities of maintenance operations. The intensity comparison unit 240 may compare the intensities of maintenance operations with reference to an intensity table 340 stored in the EEPROM 320. The details of the intensity table 340 will be described later.

The maintenance operation selection unit 250 selects the primary maintenance operation out of plural types of maintenance operations. The maintenance operation selection unit 250 may select the primary maintenance operation with reference to a type table 330 stored in the EEPROM 320. The details of the type table 330 will be described later. The memory control unit 270 stores the time information acquired by the time acquiring unit 210 in the time storage unit 350 of the EEPROM 320. The memory control unit 270 may also store information necessary for a process executed by the main control unit 200 in the EEPROM 320. The install unit 280 is used when installing various programs in the image forming apparatus 100. The programs installed by the install unit 280 may be stored in an auxiliary storage unit which is not shown or in a recording medium 290.

The maintenance operation control program executed by the main control unit 200 may be stored in the recording medium 290, from which the program may be installed on the image forming apparatus 100 by the install unit 280 via a driver unit (not shown). The recording medium 290 may be a computer-readable recording medium, such as a CD-ROM (Compact Disk Read Only Memory) or a portable memory devices such as a USB (Universal Serial Bus) memory.

FIG. 6 is an example of the type table 330 which relates the maintenance operation type identifier, the standing time, and the maintenance operation to one another. The maintenance operation includes maintenance operations that are performed when no air is detected in the sub-tank 111 and maintenance operations that are performed when air is detected in the sub-tank 111. The various maintenance operations are associated with the various standing times. Air in the sub-tank 111 may be detected using two electrodes (not shown) disposed within the sub-tank 111 and by detecting a voltage change between them.

FIG. 7 is an example of the intensity table 340. In the intensity table 340, the maintenance operation type identifier, the maintenance operation, and the intensity of maintenance operation are related to one another.

In accordance with the present embodiment, based on the type table 330 and the intensity table 340, when no air is detected in the sub-tank 111, maintenance operations having increasingly higher intensity are associated with longer standing times. The "intensity" of the maintenance operation indicates various levels associated with different maintenance operations in advance. The levels may be set in advance based on the amount of waste fluid produced by the maintenance operations.

Figure 8:
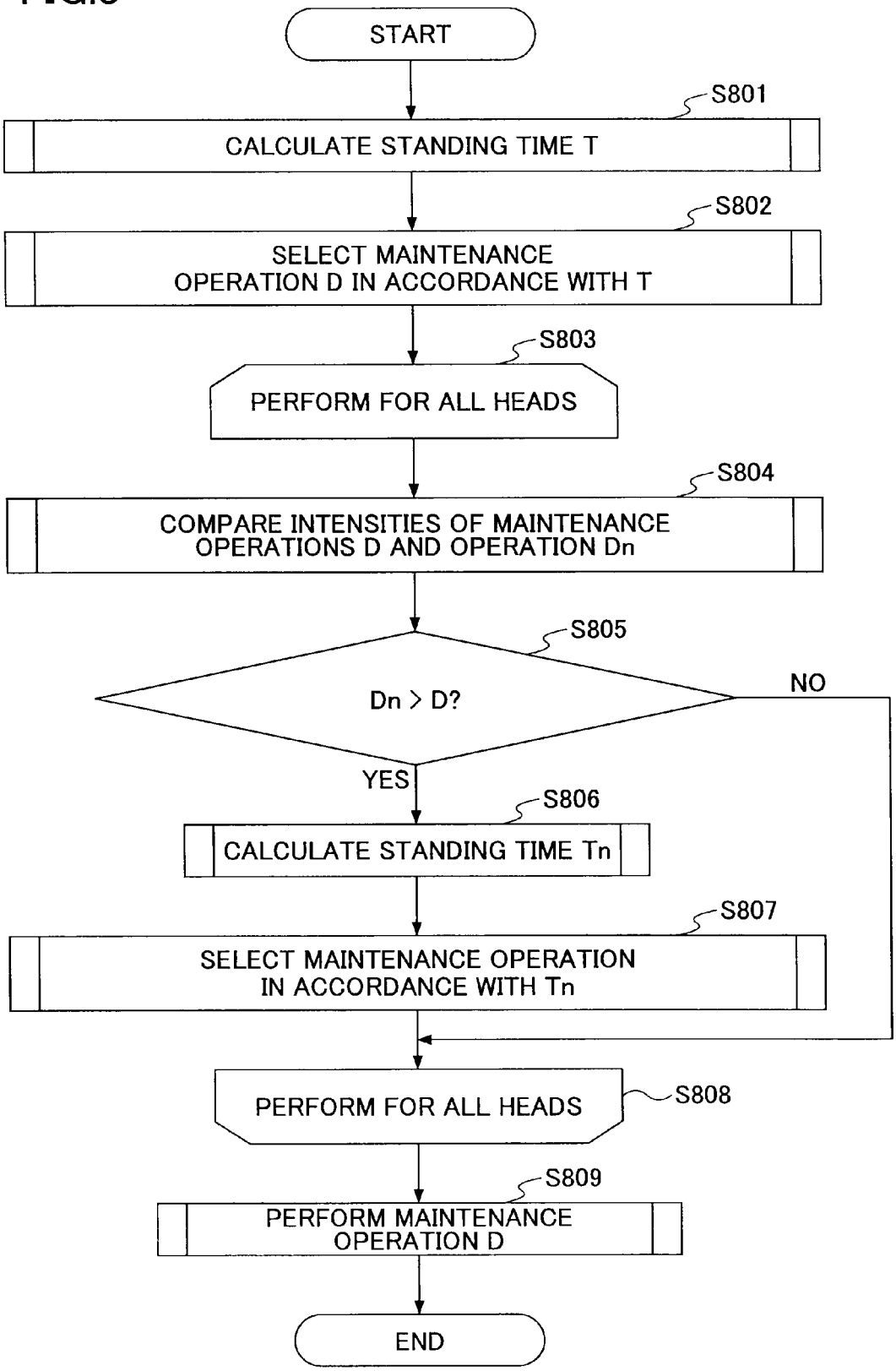
FIG. 8 is a flowchart of a maintenance operation according to the first embodiment.

FIG. 8 is a flowchart of a maintenance operation performed by the image forming apparatus 100 in accordance with the first embodiment. In the present embodiment, when plural secondary maintenance operations are performed after completion of a print operation, the last secondary maintenance operation Dn alone is taken into consideration.

The primary standing time T is calculated by the primary standing time calculation unit 220 of the main control unit 200 (step S801) as described above. During the calculation of the primary standing time T, the memory control unit 270 may store the print operation completion time acquired by the time acquiring unit 210 in the time storage unit 350 of the EEPROM 320.

Based on the primary standing time T calculated in step S801 and the type table 330, the maintenance operation selection unit 250 selects the primary maintenance operation D (step S802).

Upon selection of the primary maintenance operation D, the process from step S804 through step S807 is repeated the same number of times as the number of the recording heads 110 (step S803). The process enters a loop in step S803 because the subsequent processes are performed for each of the plural recording heads 110 (there are four heads in the present embodiment). Generally, a maintenance operation is performed for the recording heads 110 individually. Thus, preferably, the type of the primary maintenance operation is adjusted on an individual recording head basis.

In step S804, the intensity comparison unit 240 compares the intensity of the last secondary maintenance operation Dn with the intensity of the primary maintenance operation D. In accordance with the present embodiment, each time the secondary maintenance operation is completed after completion of a printing operation, information about the time at which the secondary maintenance operation is completed ("time information") may be acquired by the time acquiring unit 210 and then stored in the time storage unit 350 of the EEPROM 320 by the memory control unit 270. For example, if the last secondary maintenance operation is the secondary maintenance operation D2 (see FIG. 4), the time acquiring unit 210 acquires the time information of the secondary maintenance operation D2. The acquired time information is stored in the time storage unit 350 by the memory control unit 270. The time acquiring unit 210 may acquire the type identifier of the secondary maintenance operation that has been performed, as well as the time information. Further, the memory control unit 270 may store the time information of the secondary maintenance operation in the time storage unit 350 in association with the maintenance operation type identifier.

The intensity comparison unit 240 determines the intensity of the primary maintenance operation D by referring to the intensity table 340. Also, the intensity comparison unit 240 determines the intensity of the secondary maintenance operation Dn stored in the time storage unit 350 by referring to the intensity table 340. The intensity comparison unit 240 then compares the intensities of the primary maintenance operation D and the secondary maintenance operation Dn.

When the intensity of the secondary maintenance operation Dn is greater ("Yes" in step S805), the secondary standing time calculation unit 230 calculates the secondary standing time Tn (step S806), as described above. When the intensity of the secondary maintenance operation Dn is smaller ("No" in S805), the routine proceeds to step S808.

Once the secondary standing time Tn is calculated, the maintenance operation selection unit 250 selects a type of maintenance operation corresponding to the secondary standing time Tn, by referring to the type table 330 (step S807). The process from step S804 through step S807 is repeated the same number of times as the number of the recording heads 110 (step S808). The maintenance operation executing unit 260 then executes the maintenance operation selected in step S807 as the primary maintenance operation D (step S809).

Thus, in accordance with the present embodiment, after completion of a print operation, if a secondary maintenance operation is performed during the primary standing time T, and if the intensity of the secondary maintenance operation is greater than that of the primary maintenance operation D, the intensity of the primary maintenance operation D is lowered. In this way, the secondary maintenance operation is taken into account when selecting the primary maintenance operation, which is performed after the primary standing time T. Thus, in accordance with the present embodiment, the intensity of the primary maintenance operation is adjusted in view of the secondary maintenance operation, so that the consumption of ink by the primary maintenance operation can be reduced.

Further, in accordance with the present embodiment, it is only necessary to store the completion time of the secondary maintenance operation that is performed last during the primary standing time T. Thus, the EEPROM 320 does not require a large capacity, and the intensity of the primary maintenance operation can be adjusted using a simple control procedure.

Second Embodiment

The second embodiment differs from the first embodiment in that all of the secondary maintenance operations performed during the primary standing time T are taken into account. Thus, the following description of the second embodiment concerns the difference from the first embodiment only, with units or parts having similar functional structures to those of the first embodiment being designated with similar numerals or signs, while omitting the description of such similar units or parts.

Figure 9:
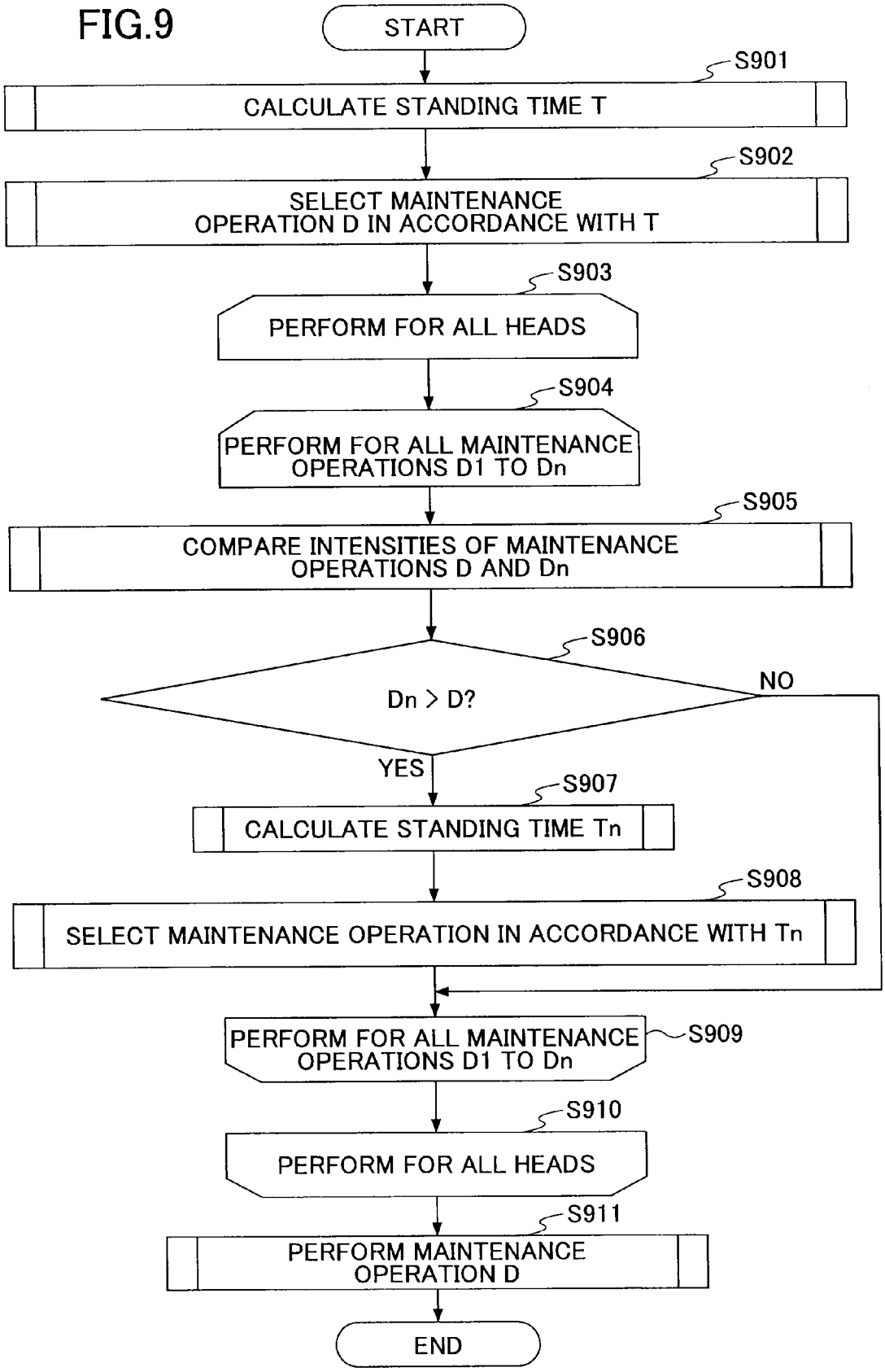
FIG. 9 is a flowchart of a maintenance operation according to a second embodiment.

FIG. 9 is a flowchart of a maintenance operation according to the second embodiment. The process from step S901 through step S903 is the same as the process from step S801 through step S803 of FIG. 8 and therefore its description is omitted. In accordance with the present embodiment, the main control unit 200 repeats the process in a loop between step S905 and step S908 for all of the secondary maintenance operations performed during the primary standing time T. The process from step S905 through step S908 of FIG. 9 is the same as the process from step S804 through step S807 of FIG. 8 and therefore its description is omitted.

When the process in the loop between step S904 and step S909 is completed, the process in another loop between step S903 and step S910 is repeated the same number of times as the number of the recording heads 110. The maintenance operation selected by the maintenance operation executing unit 260 in step S908 is performed as the primary maintenance operation D (step S911).

Thus, in accordance with the second embodiment, all of the secondary maintenance operations performed during the primary standing time T are taken into account, so that the primary maintenance operation that is more appropriate and less wasteful can be selected.

Third Embodiment

The third embodiment differs from the first embodiment in the manner of calculating the standing time. Thus, the following description of the third embodiment only concerns the difference from the first embodiment, with units or parts having similar functional structures as those of the first embodiment being designated with similar reference numerals or signs while omitting their description.

Figure 10:
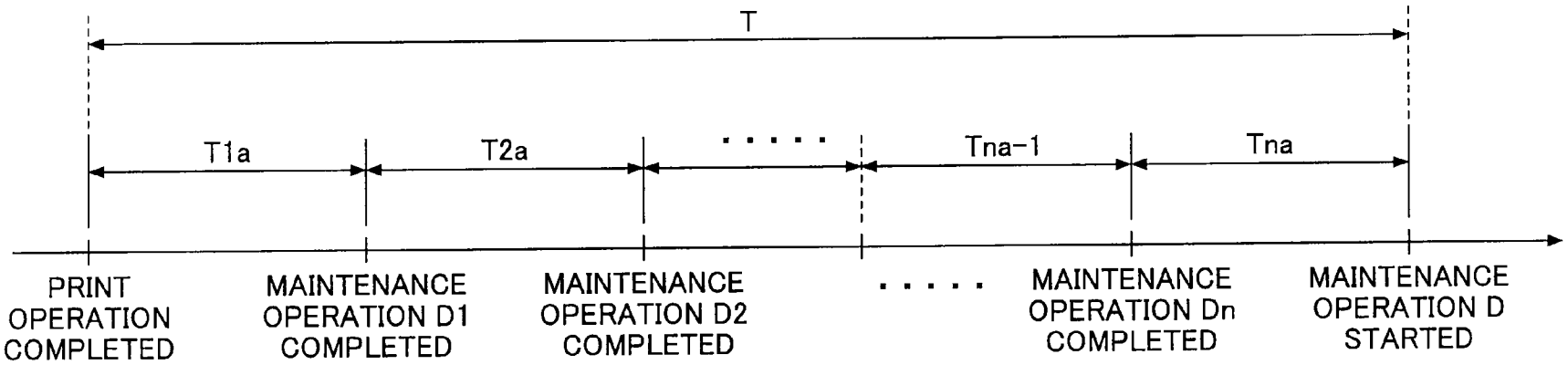
FIG. 10 illustrates the concept of a standing time according to a third embodiment.

With reference to FIG. 10, the concept of standing time in the third embodiment is described. In the foregoing the first embodiment, the secondary standing time Tn between the completion time of the last secondary maintenance operation and the end time of the primary standing time T is calculated. In contrast, the third embodiment takes into account the duration of time between the print operation completion time and completion of a first secondary maintenance operation, the duration of time between the completion of the first secondary maintenance operation and completion of a second secondary maintenance operation, and so on, as secondary standing times.

Specifically, the time between the print operation completion time and the completion of the first secondary maintenance operation D1 is standing time T1*a*; the time between the completion of the first secondary maintenance operation D1 and the completion of the second secondary maintenance operation D2 is standing time T2*a*; and the time between the completion of the last-but-one secondary maintenance operation Dn−1 and the completion of the last secondary maintenance operation Dn is secondary standing time Tna−1. The time between the completion of the last secondary maintenance operation Dn and the start of the primary maintenance operation D is secondary standing time Tna.

Figure 11:
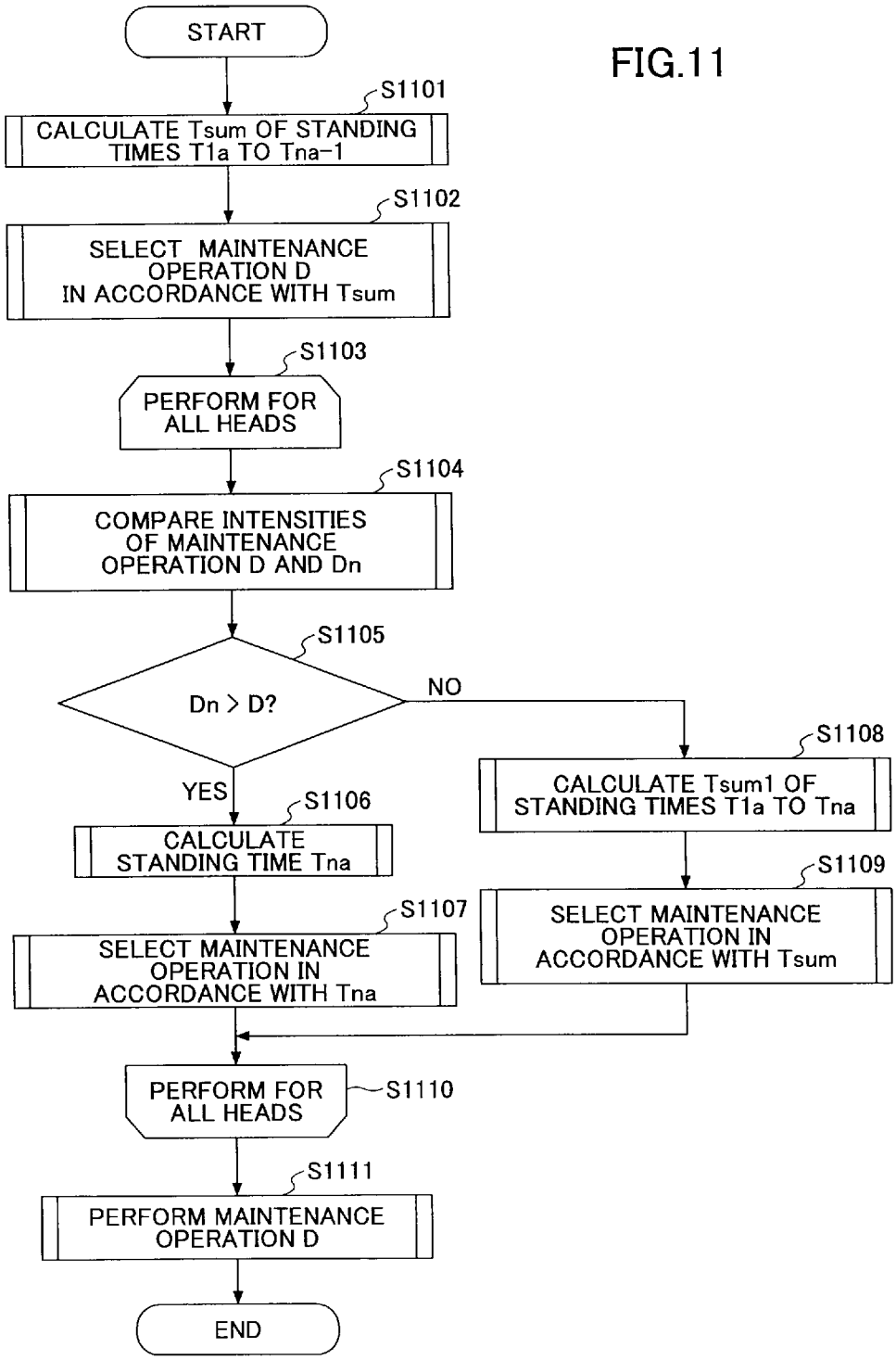
FIG. 11 is a flowchart of a maintenance operation according to the third embodiment.

FIG. 11 is a flowchart of a maintenance operation according to the third embodiment, in which the last secondary maintenance operation Dn alone in the primary standing time T is taken into account, as in the first embodiment. First, the secondary standing time calculation unit 230 calculates a sum Tsum of the secondary standing times between T1*a* and Tna−1 (step S1101). The maintenance operation selection unit 250 then selects, by referring to the type table 330, a maintenance operation corresponding to the sum Tsum calculated in step S1101 as the primary maintenance operation D (step S1102). The process from step S1104 through step S1109 is repeated for the same number of times as the number of the recording heads 110 (step S1103).

The intensity comparison unit 240, by referring to the intensity table 340, compares the intensity of the primary maintenance operation D selected in step S1102 with the intensity of the secondary maintenance operation Dn performed last in the primary standing time T (step S1104). When the intensity of the secondary maintenance operation Dn is greater than the intensity of the primary maintenance operation D selected in step S1102 ("Yes" in step S1105), the secondary standing time calculation unit 230 calculates the secondary standing time Tna (step S1106). The secondary standing time calculation unit 230 may calculate the secondary standing time Tna based on the completion time of the secondary maintenance operation Dn and the end time of the primary standing time T stored in the time storage unit 350.

Once the secondary standing time Tna is calculated, the maintenance operation selection unit 250 selects, by referring to the type table 330, a maintenance operation corresponding to the secondary standing time Tna as the primary maintenance operation D (step S1107).

When the intensity of the secondary maintenance operation Dn is lower than the intensity of the primary maintenance operation D selected in step S1102 ("No" in step S1105), the secondary standing time calculation unit 230 calculates a sum Tsum1 of the secondary standing times between T1*a* and Tna (step S1108), the sum Tsum1 corresponding to the primary standing time T. The maintenance operation selection unit 250, by referring to the type table, then selects a maintenance operation corresponding to the sum Tsum1 as the primary maintenance operation D (step S1109).

After the process from step S1104 through step S1109 is repeated the same number of times as the number of the recording heads 110 (step S1110), the primary maintenance operation D selected by the maintenance operation executing unit 260 is executed after the primary standing time T (step S1111).

Alternatively, instead of calculating the sum Tsum of the secondary standing times in step S1101, the end time of only one secondary standing time may be stored in the time storage unit 350 and updated upon completion of each subsequent secondary maintenance operation.

In the foregoing first embodiment, the intensity of the primary maintenance operation D corresponding to the primary standing time T is compared with the intensity of the last secondary maintenance operation Dn only. However, a normal state of the nozzle of the recording heads 110 may have been recovered by the last secondary maintenance operation Dn, depending on its type. Therefore, in accordance with the third embodiment, a more appropriate primary maintenance operation D can be performed than is possible with the first embodiment.

Fourth Embodiment

The fourth embodiment of the present invention differs from the third embodiment in that all of the secondary maintenance operations performed in the primary standing time T are taken into account. Thus, the following description of the fourth embodiment only concerns the difference from the third embodiment, with the units or parts having similar functional structures to those of the third embodiment being designated with similar reference numerals or signs while omitting their description.

Figure 12:
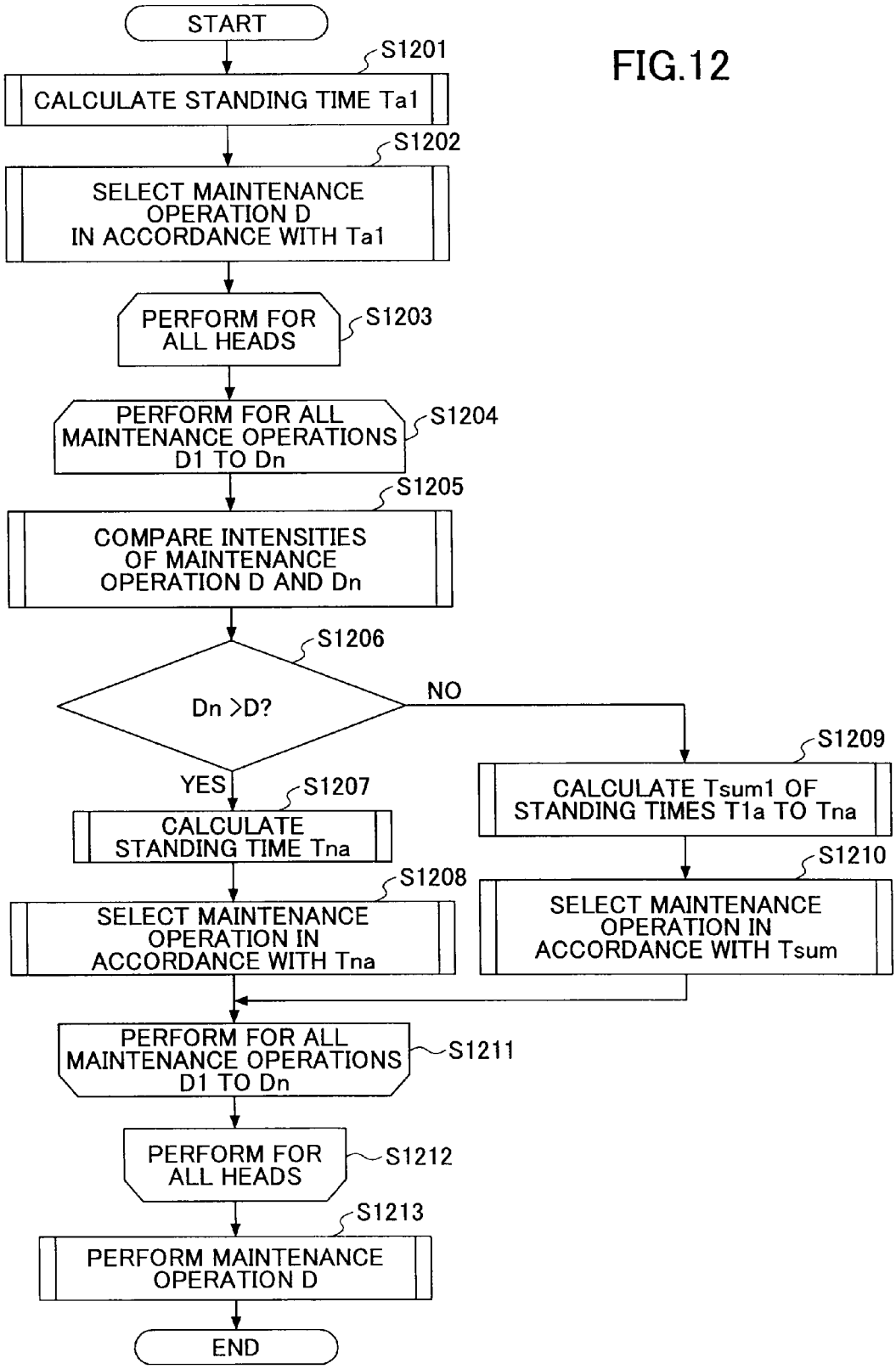
FIG. 12 is a flowchart of a maintenance operation according to a fourth embodiment.

FIG. 12 is a flowchart of a maintenance operation according to the fourth embodiment. First, the secondary standing time calculation unit 230 calculates the secondary standing time T1*a* (step S1201; see also FIG. 10). Then, the maintenance operation selection unit 250 selects the primary maintenance operation D corresponding to the secondary standing time T1*a*, by referring to the type table 330 (step S1202).

The process in a loop between step S1203 and step S1212 is repeated the same number of times as the number of the recording heads 110. The process in another loop between step S1204 and step S1211 is repeated the same number of times as the number of the secondary maintenance operations performed in the primary standing time T. The process from step S1205 through step S1210 is the same as the process from step S1104 through step S1109 of FIG. 11, and therefore its description is omitted.

The maintenance operation executing unit 260 performs the maintenance operation finally selected in step S1208 as the primary maintenance operation D performed after the primary standing time T (step S1213).

Thus, in accordance with the fourth embodiment, all of the secondary maintenance operations performed in the primary standing time T are taken into account, so that a more appropriate and less wasteful maintenance operation can be selected.

Fifth Embodiment

Figure 13:
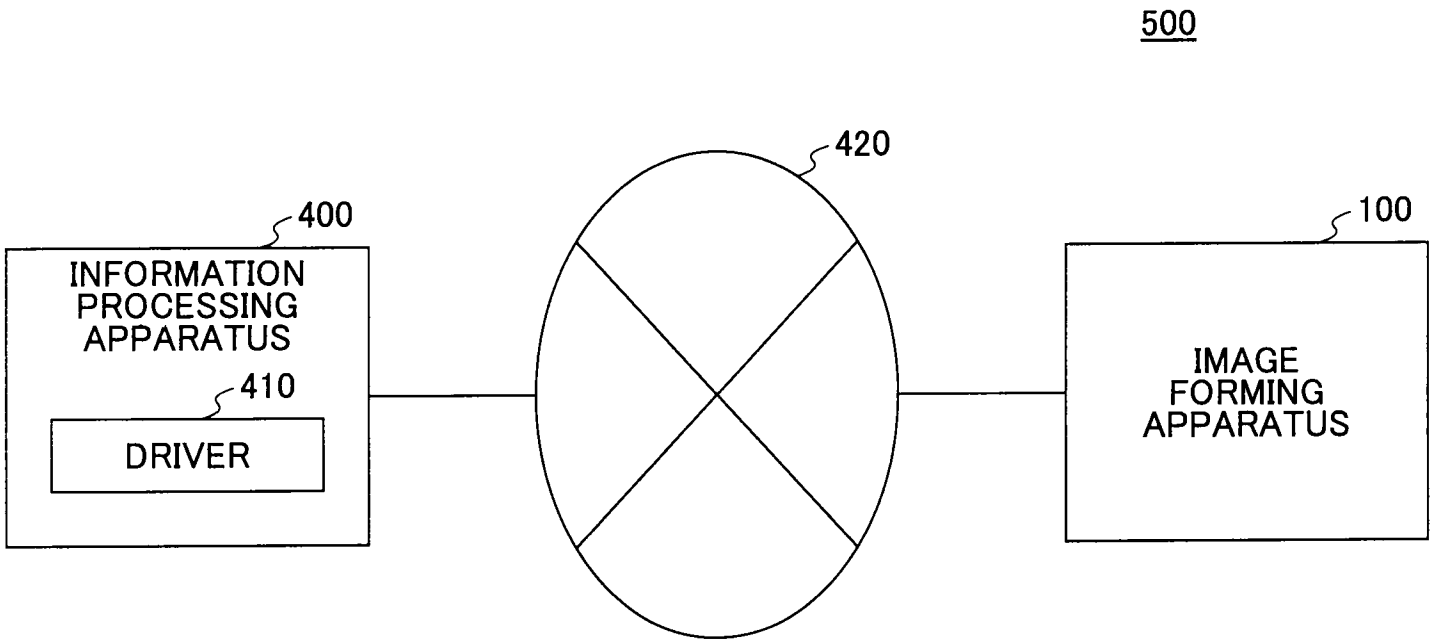
FIG. 13 is a block diagram of a system according to a fifth embodiment of the present invention.

FIG. 13 depicts a system 500 in accordance with the fifth embodiment of the present invention. The system 500 includes the image forming apparatus 100 described with reference to the first through the fourth embodiments, and an information processing apparatus 400 connected to the image forming apparatus 100 via a network 420. The information processing apparatus 400 may be realized with a conventional personal computer having a processor unit and a storage unit. The information processing apparatus 400 includes a driver 410 for operating the image forming apparatus 100.

In accordance with the fifth embodiment, it can be selected, using a function of the driver 410 in the information processing apparatus 400, whether the control of the maintenance operations described with reference to the foregoing embodiments should be exerted in the image forming apparatus 100. For example, the information processing apparatus 400 includes a display unit (not shown) configured to display a screen for operating the image forming apparatus 100, using the function of the driver 410. The operating screen may include a pull-down menu or a check box for selecting whether a control of a maintenance operation should be exerted. The information processing apparatus 400 may be connected to the image forming apparatus 100 in ways other than via the network 420 as long as the information processing apparatus 400 and the image forming apparatus 100 can communicate with each other.

Although this invention has been described in detail with reference to certain embodiments, variations and modifications exist within the scope and spirit of the invention as described and defined in the following claims.

The present application is based on the Japanese Priority Application No. 2009-052468 filed Mar. 5, 2009, the entire contents of which are hereby incorporated by reference.

What is claimed is:

1. An image forming apparatus comprising:

a recording head for discharging an ink droplet onto a recording medium in a print operation;

a maintenance operation unit configured to perform a primary maintenance operation on the recording head after a predetermined time following completion of the print operation;

a standing time calculation unit configured to calculate a standing time between a completion time of a secondary maintenance operation performed in the predetermined time and an end time of the predetermined time;

an intensity comparing unit configured to compare an intensity of the primary maintenance operation and an intensity of the secondary maintenance operation; and a selection unit configured to select a type of the primary maintenance operation based on the standing time when the intensity of the secondary maintenance operation is greater than the intensity of the primary maintenance operation.

2. The image forming apparatus according to claim 1, wherein the secondary maintenance operation is one of a plurality of the secondary maintenance operations that is performed last during the predetermined time.

3. The image forming apparatus according to claim 1, further comprising a type table in which various types of maintenance operations are associated with various durations of the standing time, wherein the selection unit is configured to select the type of the primary maintenance operation based on the standing time and with reference to the type table.

4. The image forming apparatus according to claim 1, further comprising an intensity table in which various types of maintenance operations are associated with various intensities, wherein the intensity comparing unit is configured to compare the intensity of the primary maintenance operation with the intensity of the secondary maintenance operation based on the standing time and with reference to the intensity table.

5. The image forming apparatus according to claim 1, further comprising a storage unit configured to store time information indicating a completion time of the print operation and another time information indicating the completion time of the secondary maintenance operation.

6. The image forming apparatus according to claim 5, wherein the secondary maintenance operation is one of a plurality of the secondary maintenance operations that is performed last during the predetermined time.

7. The image forming apparatus according to claim 5, wherein the storage unit is configured to store the completion times of all of a plurality of the secondary maintenance operations performed during the predetermined time.

8. The image forming apparatus according to claim 1, wherein the secondary maintenance operation includes a first secondary maintenance operation and a second secondary maintenance operation performed after the first secondary maintenance operation, wherein the standing time calculation unit is configured to calculate a duration of time between the completion time of the first secondary maintenance operation and a completion time of the second secondary maintenance operation, as the standing time.

9. A method of controlling a recording head maintenance operation in an image forming apparatus having a recording head for discharging an ink droplet onto a recording medium in a print operation, the image forming apparatus further including a maintenance operation unit configured to perform a primary maintenance operation on the recording head after a predetermined time following completion of the print operation, the method comprising:

calculating a standing time between a completion time of a secondary maintenance operation performed in the predetermined time and an end time of the predetermined time;

comparing an intensity of the primary maintenance operation and an intensity of the secondary maintenance operation; and selecting a type of the primary maintenance operation based on the standing time when the intensity of the secondary maintenance operation is greater than the intensity of the primary maintenance operation.

* * * * *